United States Patent [19]

Paskert

[11] Patent Number: 4,993,761

[45] Date of Patent: Feb. 19, 1991

[54] POSITIVE LOCK FOR SLIDING CLOSURE

[76] Inventor: John E. Paskert, 2582-F Arlington Mill Dr., Arlington, Va. 22206

[21] Appl. No.: 532,650

[22] Filed: Jun. 4, 1990

[51] Int. Cl.[5] ..... E05C 19/18

[52] U.S. Cl. ..... 292/288; 292/DIG. 46

[58] Field of Search ..... 292/DIG. 46, 258, 263, 292/288, 339, 259, 305

[56] References Cited

U.S. PATENT DOCUMENTS

| | | | |
|---|---|---|---|
| 1,838,713 | 12/1931 | Solomon | 292/305 X |
| 3,825,290 | 7/1974 | Messina et al. | 292/DIG. 46 X |
| 3,993,336 | 11/1976 | Frost | 292/DIG. 46 X |
| 4,383,708 | 5/1983 | Lamberth | 292/204 |
| 4,570,985 | 2/1986 | Waldo et al. | 292/DIG. 46 X |
| 4,798,407 | 1/1989 | Miller | 292/DIG. 46 X |
| 4,875,349 | 10/1989 | Girard | 292/DIG. 46 X |

*Primary Examiner*—Richard E. Moore

*Attorney, Agent, or Firm*—Walter F. Wessendorf, Jr.

[57] ABSTRACT

A removable elongated positive lock for a sliding closure unit having fixed vertical framing structures and a sill mounting a fixed door and a sliding door movable to open and closed positions, with each of the fixed and sliding doors having oppositely disposed vertical end frame members and a horizontal bottom frame member. The elongated positive lock engages the fixed vertical framing structures and one of the sliding door's vertical end frame members to effect positive lock of the sliding door in its closed position to prevent forced entry. Insulation carried by the positive lock insulates and seals the door sill and both fixed and sliding doors against cold conducted from the outside as well as drafts.

20 Claims, 2 Drawing Sheets

POSITIVE LOCK FOR SLIDING CLOSURE

BACKGROUND OF THE INVENTION

1. Technical Field

This invention relates to an elongated positive lock for sliding closure for use with a sliding closure unit, such as a sliding door unit, to not only provide a positive lock to prevent forced entry but also to insulate and seal the door sill, the fixed door and movable door against cold conducted from the outside and drafts.

2. Background

A conventional sliding closure unit has fixed vertical framing structures and a sill which mount a fixed door and a movable sliding door. Both the fixed door and movable door have glass panels encased in oppositely disposed vertical end frame members and horizontal top and bottom frame members. The movable door rides on or within a sill track. One of the fixed vertical framing structures and the one of the movable door's immediately adjacent vertical end frame members conventionally employ a cooperating locking mechanism to lock the movable door when it is closed to prevent outside entry. However, forced outside entry can be easily effected. Not only is cold conducted from the outside through the horizontal bottom frame members of both the fixed and movable doors, but also cold drafts enter from the outside between the sill and the movable door's horizontal bottom frame member. Hence, there is a need for a positive lock to prevent outside forced entry through the movable door other than outside forced entry gained by breaking either or both the fixed door and movable door, or breaking the conventional locking mechanism, and the further need to insulate and seal the door seal and both fixed and movable doors against cold conducted from the outside and drafts.

SUMMARY OF THE INVENTION

Accordingly, the objects of the invention are to contribute to the solution of the discussed problems of the prior art by providing an elongated positive lock that can be easily emplaced to complementally engage the fixed vertical framing structures and sill and the horizontal bottom frame members of both the fixed and movable doors to positively lock the movable door when it is closed, and with dense foam rubber carried by the elongated positive lock to insulate and seal the door sill and both horizontal bottom frame members of both the fixed and movable doors against cold conducted from the outside and drafts.

BRIEF DESCRIPTION OF THE DRAWINGS

These objects and other objects of the invention should be discerned and appreciated by reference to the detailed description of the preferred embodiment taken in conjunction with the drawings, wherein like reference numerals refer to similar parts, in which.

DETAILED DESCRIPTION OF THE PREFERRED EMBODIMENT

Figure 1:
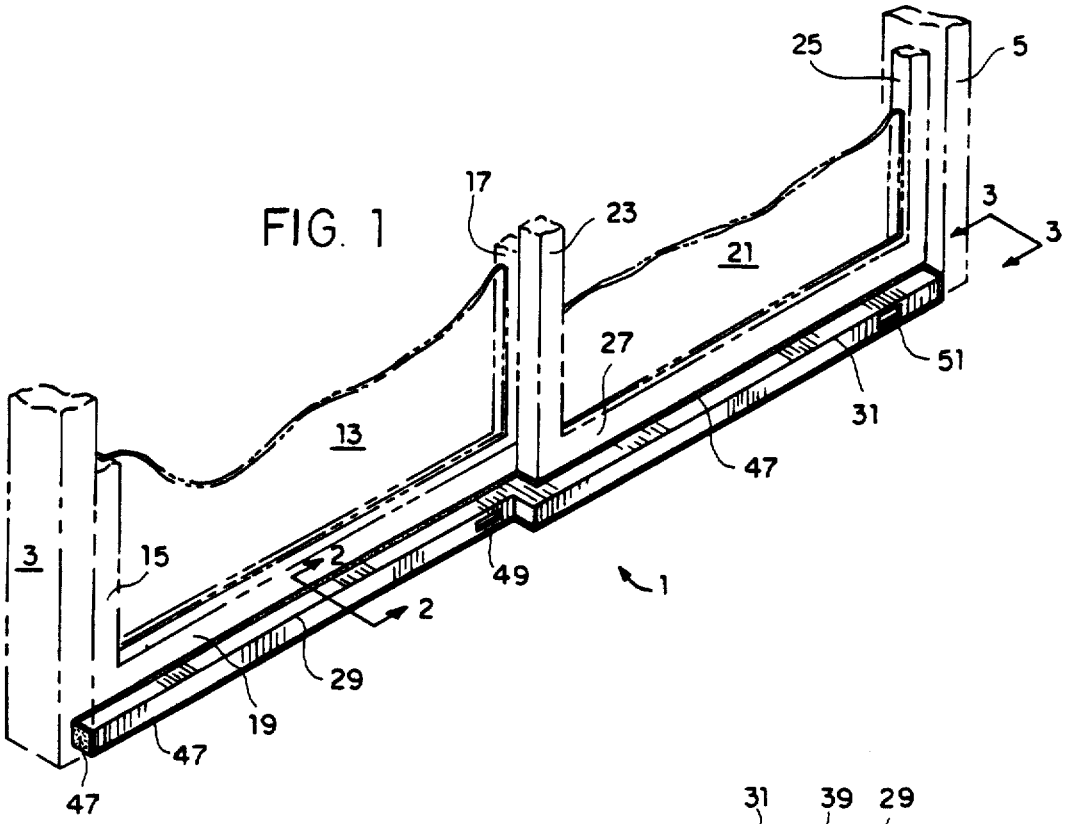
FIG. 1 is a perspective view of the invention shown operatively employed with respect to a sliding closure unit.
Figure 2:
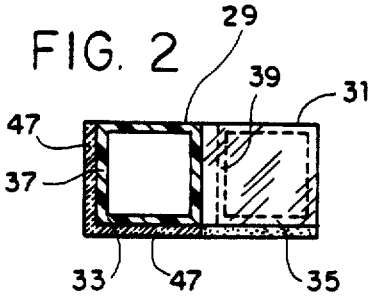
FIG. 2 is a sectional view taken in the direction of the arrows 2—2 in FIG. 1.
Figure 3:
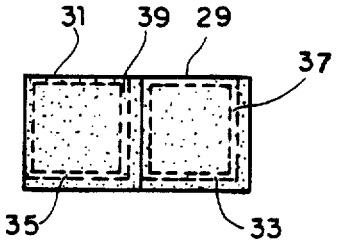
FIG. 3 is an end view in the direction of the arrows 3—3 in FIG. 1.
Figure 4:
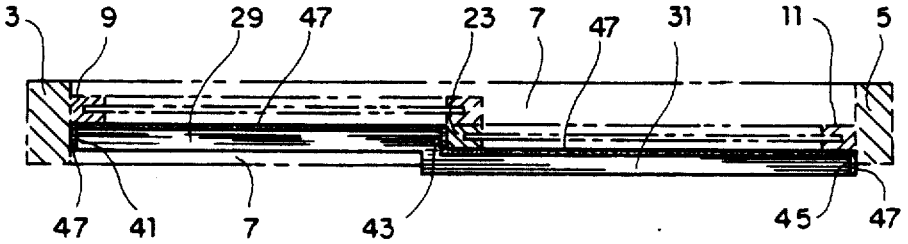
FIG. 4 is a sectional view through the sliding closure unit in FIG. 1.

In FIG. 1 of the drawings, reference numeral 1 generally refers to the invention of the elongated positive lock. The sliding enclosure has fixed vertical framing structures 3 and 5 and a sill 7 which mount a conventional fixed door 9 and a conventional movable sliding door 11. The fixed door 9 has a glass panel 13 encased in oppositely disposed vertical end frame members 15 and 17, a horizontal top frame member (not shown) and a horizontal bottom frame member 19. The movable sliding door 11 has a glass panel 21 encased in oppositely disposed vertical end frame members 23 and 25, a horizontal top frame member (not shown) and a horizontal bottom frame member 27. Elongated positive lock 1, of integral, one-piece construction, is made of square aluminum tubing, or other suitable material, and has one element 29 offset from the other element 31. Elements 29 and 31 have respective coplanar bottom portions 33 and 35 which interface with and complementally engage the sill 7, and respective lateral sides 37 and 39 which interface with and complementally engage the sides in common of the respective horizontal bottom frame members 19 and 27. Element 29 has square ends 41 and 43 which interface with and complementally engage the fixed vertical framing structure 3 and the vertical end frame member 23, respectively, when the movable door 11 is closed and thereby effects positive locking of movable door 11 in its closed position. The other element 31 has a square end 45 which correspondingly interfaces with a complementally engages the fixed vertical framing structure 5. The bottom portions 33 and 35, lateral sides 37 and 39, and square ends 41, 43 and 45 are all covered by dense rubber foam material 47, or other suitable insulating material, adhesively affixed thereto, to insulate and seal the sill 7, fixed door 9 and movable door 11 against cold conducted from the outside as well as drafts. Foot lift 49 and 51, formed in respective elements 29 and 31, allow a human operator to simply insert the front of his or her foot therein to appropriately raise the elongated positive lock 1 to facilitate its removal from such operative locking engagement herein described.

Figure 5:
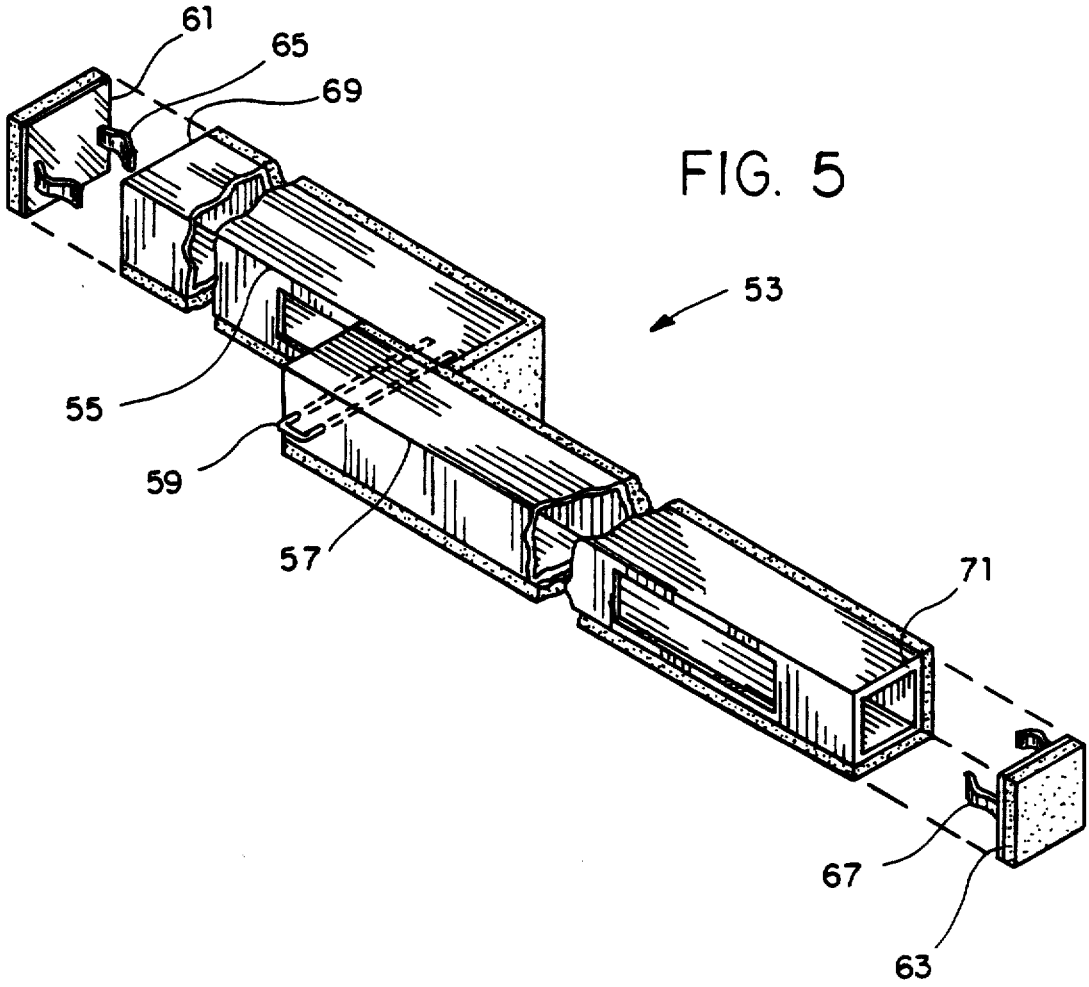
FIG. 5 is a perspective view of a modification of the elongated positive lock.

The modification 53 of the elongated positive lock, shown in FIG. 5, structurally differs from elongated positive lock 1 in that positive lock 53 has two separate elements 55 and 57, corresponding to respective elements 29 and 31, that are joined together and rigidly connected by a U-shaped pin 59 disposed through aligned holes formed in elements 55 and 57. Square end caps 61 and 63, covered by the same dense rubber foam insulating material 47, have respective spring-mounting clips 65 and 67 to mount the end caps 61 and 63 on the square ends 69 and 71 of respective elements 55 and 57. Such square end caps similarly can be mounted on the square ends 41 and 45 of respective elements 29 and 31.

I claim:

1. A removable elongated positive lock for use with a sliding closure unit having fixed vertical framing structures and a sill mounting a fixed door and a sliding door movable to open and closed positions, each of said fixed and sliding doors having oppositely disposed vertical end frame members and a horizontal bottom frame member, said elongated positive lock comprising:

first element means for engaging one of said fixed vertical framing structures and one of said vertical end frame members of said sliding door to effect positive lock of said sliding door in its closed position, second element means for engaging the other of said fixed vertical framing structures, and said first element means and said second element means being of integral, one-piece construction for rigidity.

2. A removable elongated positive lock for use with a sliding closure unit having fixed vertical framing structures and a sill mounting a fixed door and a sliding door movable to open and closed positions, each of said fixed and sliding doors having oppositely disposed vertical end frame members and a horizontal bottom frame member, said elongated positive lock comprising:

first element means for engaging one of said fixed vertical framing structures and one of said vertical end frame members of said sliding door to effect positive lock of said sliding door in its closed position, second element means for engaging the other of said fixed vertical framing structures, and said first element means and said second element means having cooperating pin means rigidly connecting together said first element means and said second element means.

3. A removable elongated positive lock in accordance with claim 1, wherein said first element means and said second element means have bottom portions interfacing with and complementally engaging said sill.

4. A removable elongated positive lock in accordance with claim 2, wherein said first element means and said second element means have bottom portions interfacing with and complementally engaging said sill.

5. A removable elongated positive lock in accordance with claim 1, wherein said first element means and said second element means have lateral sides, wherein said horizontal bottom frame members of said fixed door and said sliding door have sides in common with said lateral sides of said first element means and said second element means, and wherein said lateral sides of said first element means and said second element means interface in engaging relationship with said common sides of said fixed door and said sliding door.

6. A removable elongated positive lock in accordance with claim 2, wherein said first element means and said second element means have lateral sides, wherein said horizontal bottom frame members of said fixed door and said sliding door have sides in common with said lateral sides of said first element means and said second element means, and wherein said lateral sides of said first element means and said second element means interface in engaging relationship with said common sides of said fixed door and said sliding door.

7. A removable elongated positive lock in accordance with claim 1, wherein said first element means and said second element means have square ends interfacing with and complementally engaging said fixed vertical framing structures.

8. A removable elongated positive lock in accordance with claim 2, wherein said first element means and said second element means have square ends interfacing with and complementary engaging said fixed vertical framing structures.

9. A removable elongated positive lock in accordance with claim 1, wherein said first element means and said second element means have ends carrying end caps interfacing with and complementally engaging said fixed vertical framing structures.

10. A removable elongated positive lock in accordance with claim 2, wherein said first element means and said second element means have ends carrying end caps interfacing with and complementally engaging said fixed vertical framing structures.

11. A removable elongated positive lock in accordance with claim 1, wherein said first element means and said second element means have insulating means to insulate and seal said sill, said fixed door and said sliding door against cold conducted from the outside as well as drafts.

12. A removable elongated positive lock in accordance with claim 2, wherein said first element means and said second element means have insulating means to insulate and seal said sill, said fixed door and said sliding door against cold conducted from the outside as well as drafts.

13. A removable elongated positive lock in accordance with claim 1, wherein said first element means and said second element means have foot lift means for allowing a human operator to insert his or her foot in said foot lift means to raise said elongated positive lock to facilitate its removal.

14. A removable elongated positive lock in accordance with claim 2, wherein said first element means and said second element means have foot lift means for allowing a human operator to insert his or her foot in said foot lift means to raise said elongated positive lock to facilitate its removal.

15. A removable elongated positive lock in accordance with claim 1, wherein said first element means and said second element means have bottom portions interfacing with and complementally engaging said sill, wherein said first element means and said second element means have lateral sides, wherein said horizontal bottom frame members of said fixed door and said sliding door have sides in common with said lateral sides of said first element means and said second element means, wherein said lateral sides of said first element means and said second element means interface in engaging relationship with said common sides of said fixed door and said sliding door, wherein said first element means and said second element means have square ends interfacing with and complementally engaging said fixed vertical framing structures.

16. A removable elongated positive lock in accordance with claim 2, wherein said first element means and said second element means have bottom portions interfacing with and complementary engaging said sill, wherein said first element means and said second element means have lateral sides, wherein said horizontal bottom frame members of said fixed door and said sliding door have sides in common with said lateral sides of said first element means and said second element means, wherein said lateral sides of said first element means and said second element means interface in engaging relationship with said common sides of said fixed door and said sliding door, wherein said first element means and said second element means have square ends interfacing with and complementally engaging said fixed vertical framing structures.

17. A removable elongated positive lock in accordance with claim 15, wherein said bottom portions of said first element means and said second element means interfacing with and complementally engaging said sill carry insulating means, wherein said lateral sides of said first element means and said second element means interfacing in engaged relationship with said common sides of said fixed door and said sliding door carry insulating means, wherein said square ends of said first element means and said second element means interfacing facing with and complementally engaging said fixed vertical framing structures carry insulating means, and wherein said insulating means, as constructed and arranged, insulate and seal said sill, said fixed door and said sliding door against cold conducted from the outside as well as drafts.

18. A removable elongated positive lock in accordance with claim 10, wherein said bottom portions of said first element means and said second element means interfacing with and complementally engaging said sill carry insulating means, wherein said lateral sides of said first element means and said second element means interfacing in engaged relationship with said common sides of said fixed door and said sliding door carry insulating means, wherein said square ends of said first element means and said second element means interfacing with and complementally engaging said fixed vertical framing structures carry insulating means, and wherein said insulating means, as constructed and arranged, insulate and seal said sill, said fixed door and said sliding door against cold conducted from the outside as well as drafts.

19. A removable elongated positive lock in accordance with claim 17, wherein said insulating means is dense rubber foam material.

20. A removable elongated positive lock in accordance with claim 18, wherein said insulating means is dense rubber foam material.

* * * * *